US007360944B2

(12) United States Patent
Morel

(10) Patent No.: US 7,360,944 B2
(45) Date of Patent: Apr. 22, 2008

(54) CONTROL DEVICE WITH A DISENGAGEABLE CROWN FOR A WRISTWATCH

(75) Inventor: Laurent Morel, Bellefontaine (FR)

(73) Assignee: Richemont International SA, Villars-sur-Glane (CH)

( * ) Notice: Subject to any disclaimer, the term of this patent is extended or adjusted under 35 U.S.C. 154(b) by 134 days.

(21) Appl. No.: 10/576,926

(22) PCT Filed: Oct. 19, 2004

(86) PCT No.: PCT/IB2004/003408

§ 371 (c)(1),
(2), (4) Date: Jun. 30, 2006

(87) PCT Pub. No.: WO2005/040942

PCT Pub. Date: May 6, 2005

(65) Prior Publication Data

US 2007/0147186 A1 Jun. 28, 2007

(30) Foreign Application Priority Data

Oct. 24, 2003 (CH) ..... 1826/03

(51) Int. Cl.
*G04B 29/00* (2006.01)
*G04B 37/00* (2006.01)

(52) U.S. Cl. ..... 368/308; 368/319

(58) Field of Classification Search ..... 368/190, 368/208, 288–290, 308, 319–321
See application file for complete search history.

(56) References Cited

U.S. PATENT DOCUMENTS

| | | | | |
|---|---|---|---|---|
| 3,389,550 | A * | 6/1968 | Piquerez | 368/308 |
| 4,104,866 | A * | 8/1978 | Chappatte | 368/319 |
| 4,292,682 | A | 9/1981 | Wenger | |
| 4,362,395 | A * | 12/1982 | Calabrese | 368/146 |
| 5,383,166 | A | 1/1995 | Gallay et al. | |
| 6,886,975 | B2 * | 5/2005 | Hiranuma et al. | 368/289 |
| 7,025,494 | B2 * | 4/2006 | Oomori et al. | 368/190 |

FOREIGN PATENT DOCUMENTS

| | | |
|---|---|---|
| CH | 348 928 | 9/1960 |
| DE | 10 92 841 | 11/1960 |
| EP | 1280023 A1 | 1/2003 |

* cited by examiner

*Primary Examiner*—Vit W Miska
(74) *Attorney, Agent, or Firm*—Young & Thompson

(57) ABSTRACT

A device includes a supporting tube fixed at the case of a watch, a drive shaft with teeth extending inside the supporting tube for controlling at least one function of the watch, a crown having a crown's head and a tube with teeth integral with the crown's head that is mounted so as to be mobile in rotation and translation, between the inner wall of the supporting tube and the drive shaft, and an indexing gasket seated in the inner wall of the supporting tube and cooperating with first and second grooves provided on the outside of the mobile tube in order to define a first axial position of the crown in which the mobile tube is engaged with the drive shaft and can transmit a torque to it, and a second axial position of the crown in which the mobile tube is disengaged from the drive shaft.

14 Claims, 1 Drawing Sheet

CONTROL DEVICE WITH A DISENGAGEABLE CROWN FOR A WRISTWATCH

The present invention refers to a control device with decoupling crown for a watch, and more particularly to a control device in which the coupling and decoupling of the crown occur outside the movement.

Decoupling crowns called "screw-down" are known that can take up a coupled position where the crown is engaged with a driving stem outside the movement, and a decoupled position where the crown is disengaged from this driving stem. The change from one position of the crown to the other is obtained by screwing and unscrewing the crown in a crown tube. This operation is unpractical for users. Moreover, upon repeated use the screw threads of crown and tube tend to be damaged, particularly so at their front ends, which may necessitate replacement of this crown and tube.

The present invention aims at obviating these disadvantages, and to this end proposes a decoupling-crown control device for a watch according to appended claim 1, while specific embodiments of this device are defined in the dependent claims, as well as a watch incorporating it.

Figure 1:
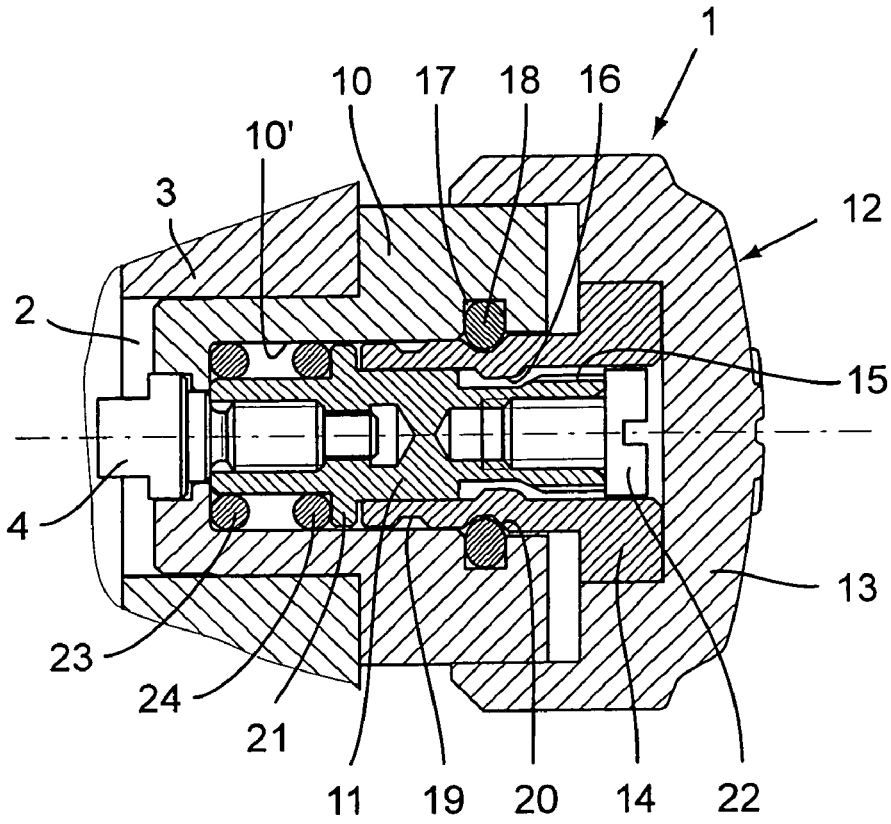
Figure 2:
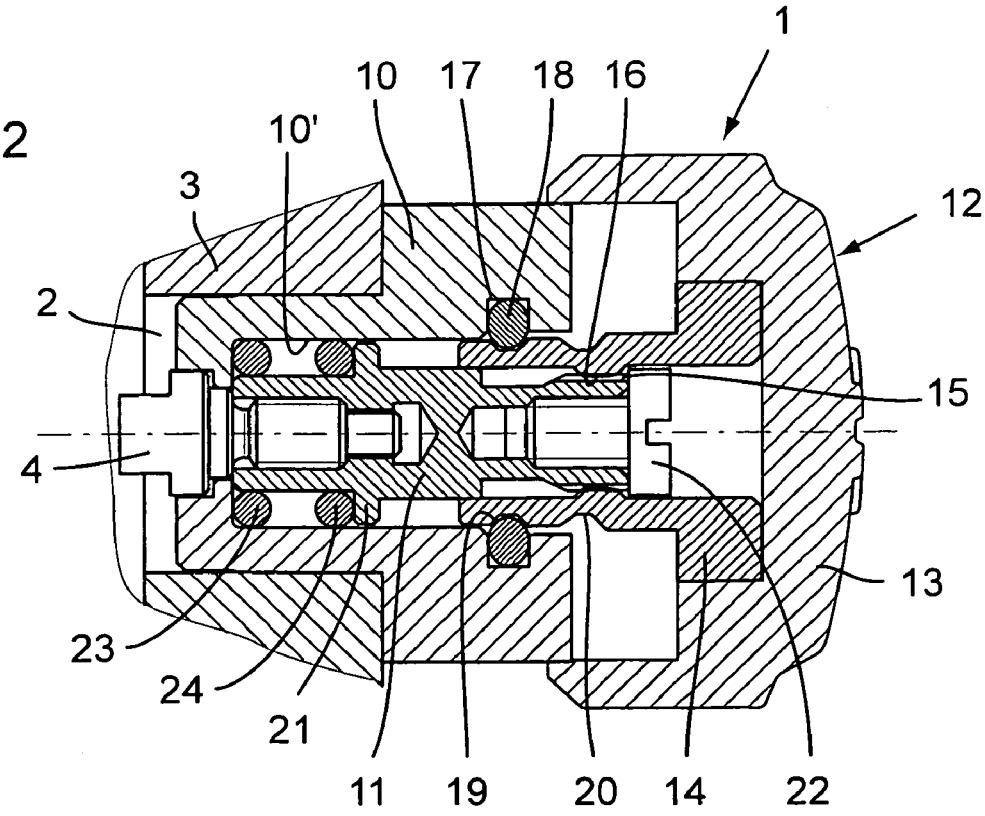

Further features and advantages of the present invention will become apparent when reading the following detailed description given while referring to the appended drawings where FIGS. 1 and 2 show the control device of the invention in a decoupled state and in a coupled state in sectional views.

Referring to FIGS. 1 and 2, a control device 1 with water-resistant decoupling crown according to the invention comprises a fixed supporting tube 10 driven into a bore 2 formed in the body (middle) 3 of a watchcase, a drive shaft 11 inserted in the fixed tube 10 that is integral with a driving stem 4 of the watch, as well as a crown 12 consisting of a crown head 13 and of a tube 14 integral with head 13 and mounted rotatably and translatably between the inner wall 10' of fixed tube 10 and the drive shaft 11. The drive shaft 11 bears outer teeth 15, the mobile tube 14 bears corresponding inner teeth 16.

An annular groove 17 formed in the inner wall 10' of the fixed tube 10 constitutes the seat for a thoric gasket 18. The outside of the mobile tube 14 has two structures, here a first and a second annular groove 19, 20, that can cooperate. with gasket 18 in order to define two stable axial positions for crown 12. In the open or pulled position that is indexed by gasket 18 and groove 19 (FIG. 2), the teeth 15 and 16 are engaged so as to enable drive shaft 11 and, thus, the driving stem 4 to be rotated when crown 12 is turned by the user. This open position is a working position where a rotation of crown 12 controls a particular function in the watch, such as a rotation of the city disc for time-zone display or any other, analogous function. In the closed or pushed position that is indexed by gasket 18 and groove 20 (FIG. 1), teeth 15 and 16 are not engaged, so that crown 12 may freely turn without driving the shaft 11. This closed position is a rest position of the mechanism where no particular function of the watch is controlled when crown 12 is turned by the user.

Two stops 21, 22, the first consisting of a collar extending around drive shaft 11 and the second consisting of the head of a screw screwed into the end of shaft 11 farthest from the watchcase, limit the axial movement of crown 12 in the direction where crown 12 comes closer to the watchcase, and in the opposite direction where crown 12 moves away from the watchcase.

Moreover, gaskets 23 and 24 arranged between the bottom portion of fixed tube 10 and collar 21 secure the tight fit between the fixed tube 10 and drive shaft 11.

The device according to the invention is mounted as follows:

1. Shaft 11 is slipped into tube 14, then the stop screw is screwed into shaft 11. After that the assembly 11, 14 is driven into the crown's head 13 and welded.
2. The two gaskets 23, 24 are slipped to the bottom portion of tube 10, and the thoric indexing gasket 18 is placed into groove 17 of tube 10.
3. The assembly 11, 13, 14 is mounted into tube 10, and the drive stem 4 is screwed and glued into shaft 11.
4. The entire assembly is driven into the middle 3 of the watch.

The present invention is not limited to the example of an embodiment described above. It will be clear to one skilled in the art that modifications can be introduced without leaving the scope of the claimed invention. For instance, fixed tube 10 could be left out, and annular groove 17 receiving the indexing gasket 18 could be formed directly in bore 2 of middle 3. Also, the relative positions of grooves 19, 20 and groove 17 could be inverted, that is, grooves 19, 20 could be formed in the inner wall 10' of fixed tube 10, while groove 17 receiving the indexing gasket 18 could be formed in the outside of mobile tube 14. Another modification could be to add one or several additional axial positions for crown 12 that are indexed, either by one or several additional annular grooves on mobile tube 14 in the device of the invention, or in the conventional way inside the watch movement, in order to allow other functions in the watch such as winding, setting, etc. to be controlled. One could also add to the device of the invention a compression key like that described in the document EP 1 280 023 in order to enhance the tight fit of the device in the rest position of crown 12.

The invention claimed is:

1. Control device with decoupling crown for a watch, characterised in that it comprises:

a supporting part (10) intended to be fixed at the watchcase (3) or consisting of the watchcase (3) itself, this supporting part (10) comprising an opening, a drive shaft (11) extending inside the opening, intended to control at least one function of the watch, and comprising first coupling means (15), a crown (12) comprising a crown's head (13) and a tube (14) integral with the crown's head (13), the tube (14) being mounted rotatably and translatably between the wall (10') of the opening and the drive shaft (11), and comprising second coupling means (16), and an indexing element (18) placed into the opening that is integral with the supporting part (10) or with the tube (14), and able to cooperate with first and second structures (19, 20) provided on the outside of the tube (14) or a wall (10') of the opening in order to define a first axial position of the crown (12) in which the first and second coupling means (15, 16) are engaged and allow the drive shaft (11) to be rotated when the crown (12) is rotated, and a second axial position of the crown (12) in which the tube (14) is disengaged from the drive shaft (11).

2. Control device of claim 1, characterised in that the supporting part (10) is a tube intended to be fixed at the watchcase (3).

3. Control device of claim 1, characterised in that the indexing element (18) is integral with the supporting part (10), and the first and second structures (19, 20) are located on the outside of the mobile tube (14).

4. Control device of claim 1, characterised in that the indexing element (18) is a gasket.

5. Control device of claim 1, characterised in that the indexing element (18) is a thoric gasket, and the first and second structures (19, 20) are annular grooves.

6. Control device of claim 5, characterised in that the thoric gasket (18) is held in an annular groove (17) formed in the wall (10') of the opening.

7. Control device of claim 1, characterised in that the first and second coupling means are outer teeth (15) and inner teeth (16), respectively.

8. Control device of claim 1, characterised in that it comprises a stop screw (22) screwed into the end of the drive shaft (11) that is farthest from the watchcase (3), in order to limit the axial movement of the crown (12) in the direction of increasing distance of the crown (12) from the watchcase (3).

9. Watch equipped with a control device according to claim 1.

10. Control device of claim 2, characterised in that the indexing element (18) is integral with the supporting part (10), and the first and second structures (19, 20) are located on the outside of the mobile tube (14).

11. Control device of claim 2, characterised in that the indexing element (18) is a gasket.

12. Control device of claim 3, characterised in that the indexing element (18) is a gasket.

13. Control device of claim 2, characterised in that the indexing element (18) is a thoric gasket, and the first and second structures (19, 20) are annular grooves.

14. Control device of claim 3, characterised in that the indexing element (18) is a thoric gasket, and the first and second structures (19, 20) are annular grooves.

* * * * *